US005387143A

United States Patent [19]

Pitman

[11] Patent Number: 5,387,143

[45] Date of Patent: Feb. 7, 1995

[54] HAND GRIP FOR AN OAR

[76] Inventor: Lockett C. Pitman, R.R. 1, Box 276 A-65, Wimberley, Tex. 78676

[21] Appl. No.: 161,127

[22] Filed: Dec. 2, 1993

[51] Int. Cl.[6] ..... B03H 16/04

[52] U.S. Cl. ..... 440/101; 16/DIG. 12

[58] Field of Search ..... 441/55, 76; 440/101, 440/105; 280/821; 16/111 R, 116 R, DIG. 12, DIG. 19

[56] References Cited

U.S. PATENT DOCUMENTS

| | | | |
|---|---|---|---|
| 3,290,049 | 12/1966 | McDonald | 280/821 |
| 3,800,734 | 4/1974 | Whang | 440/101 |
| 4,613,156 | 9/1986 | Lajos | 16/DIG. 12 |
| 4,641,857 | 2/1987 | Gailiunas | 16/DIG. 12 |

FOREIGN PATENT DOCUMENTS

| | | | |
|---|---|---|---|
| 1112170 | 3/1956 | France | 16/DIG. 12 |

*Primary Examiner*—Stephen P. Avila
*Attorney, Agent, or Firm*—Gunn, Lee & Miller

[57] ABSTRACT

A grip for a sculling oar having an elongated elastic tubular body with a truncated elliptical profile or shape. The tubular body has an open end for receiving an oar handle and an opposite closed end with a thumb depression contoured into the outer surface of the closed end. A plurality of contiguous finger grooves are formed circumferentially along the outer surface of the tubular body. The grooves extend diagonally across the elliptical portion of the body. An alignment mark is scribed on the truncated portion of the tubular body near the open end. The alignment mark is aligned with the convex face of the blade of the order to facilitate the rowing action.

5 Claims, 5 Drawing Sheets

HAND GRIP FOR AN OAR

BACKGROUND OF THE INVENTION

The present invention relates to a hand grip for an oar used in sculling. More particularly, the grip of the present invention combines a specific arrangement of finger grooves, an end, thumb groove and an orientation indicia for properly aligning these grooves with the centerline of the broad convex face of the blade on the distal or outboard end of the oar.

In the sport and recreational activity of rowing, the boat is often referred to as the shell. One type of shell is a sweep in which each rower has only one oar, called a sweep oar. The rower places both hands on the single sweep oar during the rowing action.

With a type of shell called a scull, each rower has two oars, called scull oars. One hand is placed on each separate scull oar during the rowing action.

While technological improvements have been made in oar materials composition and in blade design, very little attention has been placed on the grip of the oar. Oars are now designed to provide a generally elongated tubular rubber grip which covers the handle of the scull oar, but the current grips do little to facilitate the rowing action except to provide a non-slip gripping surface. Some grips are made of a soft rubber composition which reduces hand slippage; other grips utilize a harder elastic composition provided with a roughened, or cross-hatched, surface to increase frictional forces thereby improving the griping. Thus, most of the focus on improving the hand grip has been directed toward reducing slippage rather than on improving the grip to ultimately increase the rowing efficiency of each stroke. No special shape of grip has been developed to anatomically facilitate the most efficient power transfer from the rower to the water or to facilitate regripping the oar once it has been dropped.

An efficient rowing stroke includes several stages or positions. The "catch" is the part of the stroke when the blade is put into the water. The "pull-through" is the portion of the stroke when the blade moves through the water with the blade perpendicular to the water surface. The act of removing the blade from the water at the end of the pull through is known as the "release". The finish is the position of the rower at the end of the stroke; legs extended, leaning back, arms brought into the body, and the blade is out of the water. A stage known as "hands away" occurs where the rower is at the finish of the stroke, still leaning back but his arms are extended. The "recovery" is the portion of the stroke where the blade is out of the water; the rower moves up the slide and into position for the next catch. "Feathering" is the act of turning the oar blade parallel to the water's surface; "squaring" is the turning of the blade perpendicular to the water's surface.

In order to maximize the transfer of power from the rower to the water so as to propel the shell, the maximum surface area of the blade must be presented to the water to create the propulsion forces. Thus, blade work is a skill that has a direct impact on the movement and speed of the boat. One important aspect of blade work is squaring of the blade. The squaring, or turning of the oar so that the blade is perpendicular to the water's surface, generally starts with the rower's hands going over the ankles and it is executed at a constant speed. It should neither slow down nor stop the motion of the blade before entry into the water. The squared blade is entered into the water and synchronized with the speed of the boat in a scooping fashion. Immediate power application to the oar is provided as soon as the blade is covered in the water.

The squared blade remains buried in the water, moving horizontally at an even depth during the drive stroke. At the release the blade is lifted up and out of the water while still square. This ensures a complete transfer of the rower's power. Feathering of the oar, turning the blade parallel to the water's surface, occurs after the blade completely leaves the water. As the feathered oar is brought back to the next catch position during recovery, the blade should remain parallel to the water's surface and remain very horizontal.

The present invention provides a special and unique grip construction which ensures that the rower's hands are appropriately positioned on the oar handle such that when the oar is pulled through the water or when the oar is moved through the recovery position of the stroke, the broad face of the blade member of the oar is in its most efficient position for power transfers in the water, and the least air resistance in recovery. Further, the present inventive grip has a slightly elliptical contour along its outer surface to encourage use of the fingers by the rower and reduce contact of the palms with the grip.

Further yet, the present inventive grip provides a structure whereby the oar may be regripped, if accidentally dropped during rowing, without the rower looking out at the blade end to determine its relative position to the water surface. The unique arrangement of the elements of the present invention ensures that once the oar grip is regrasped, the rower knows the orientation of the blade.

SUMMARY OF THE INVENTION

The present invention is a hand grip for an oar. The grip has an elongated elastic tubular body adapted to stretchingly fit over the handle end of the oar. The tubular body of the grip has an outboard open end into which the oar handle is inserted. The inboard end of the grip is closed but contoured to readily accept the rower's thumb when the grip is properly grasped. The tubular body of the grip has a truncated ellipse shape with the truncated portion presenting a generally flat surface from the open end to the closed end of the body. Around nearly three-fourths of the non-truncated portion of the circumference of the outer surface of the body portion, a series of contiguous finger grooves are formed and are slightly angled across the longitudinal axis of the body to accommodate the rower's fingers during gripping of the oar. An alignment mark or indicia on the flat, truncated portion of the grip is provided to ensure appropriate alignment of the grip on the handle in relation to the face or broad surface of the blade. When the alignment mark is aligned with the centerline of the convex face of the blade, which faces the bow of the boat during rowing operations, the present inventive grip facilitates the proper squaring and feathering of the blade without having to look out at the blade orientation.

DETAILED DESCRIPTION OF THE PREFERRED EMBODIMENT

Figure 1:
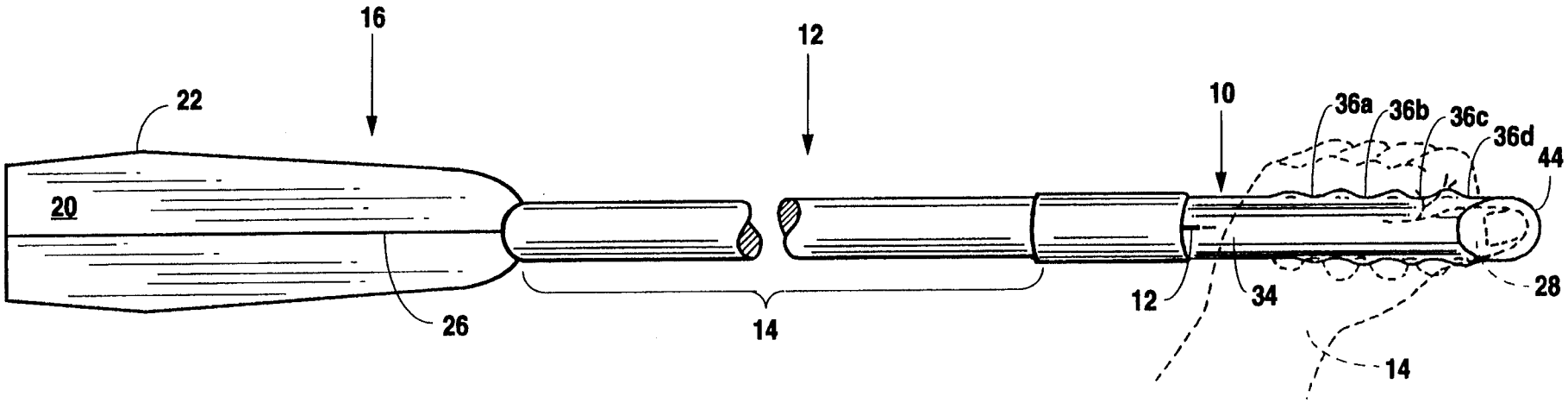
FIG. 1 is a broken perspective view of an oar with a present inventive left grip affixed over the handle of an oar. The rower's left hand is shown in broken lines.

FIG. 1 illustrates the present inventive grip (left) 10 shown attached over the handle of a scull oar 12. FIG. 1 shows the rower's left hand 14 in broken lines. FIG. 1 is not intended to illustrate the proportionate sizes of the elements in the drawing. For the purposes of describing the present invention, a left grip is illustrated and discussed; however, it should be understood that a mirror image description may be given for a right hand grip as is given herein for the left hand grip.

Oar 12 has a generally cylindrical shaft portion 14 with a blade member 16 on the outboard end of the shaft 14. The handle (not actually seen in FIG. 1) is inside of the grip 10 and is on the inboard end of the shaft.

Blade 16 has a first broad face 20 which is convex and an opposite second broad face (not shown) which is concave. A thin top edge 22 and a thin bottom edge 24 may be noted in FIG. 1. A centerline 26, equidistant from top edge 22 and bottom edge 24, is illustrated on the first face 20 of blade 16 and provides a ready reference for alignment of the present invention as will be discussed below.

The oar 12 shown in FIG. 1 is in the squared position wherein the blade would be perpendicular to the surface of the water. It should be noted that the rower's thumb 28 is received in thumb groove 44 in grip 10. Also, as may be seen in FIG. 1, the rower's fingers are wrapped around grip 10 and extend away from the rower and toward the stern of the shell. Alignment mark or indicia 32 is shown on the flat surface (truncated portion) 34 of grip 10. This flat surface 34 generally aligns with the palm of the rower and has no finger grooves in it. As may further be seen in FIG. 1, alignment mark 32 is longitudinally aligned with the centerline 26 of blade 16 so that the finger grooves 36*a–c* and index finger surface 36*d* are generally aligned with the second face (concave) of blade 16 and the flat surface 34 of grip 10 is aligned with the first face (convex) of blade 16.

Figure 2:
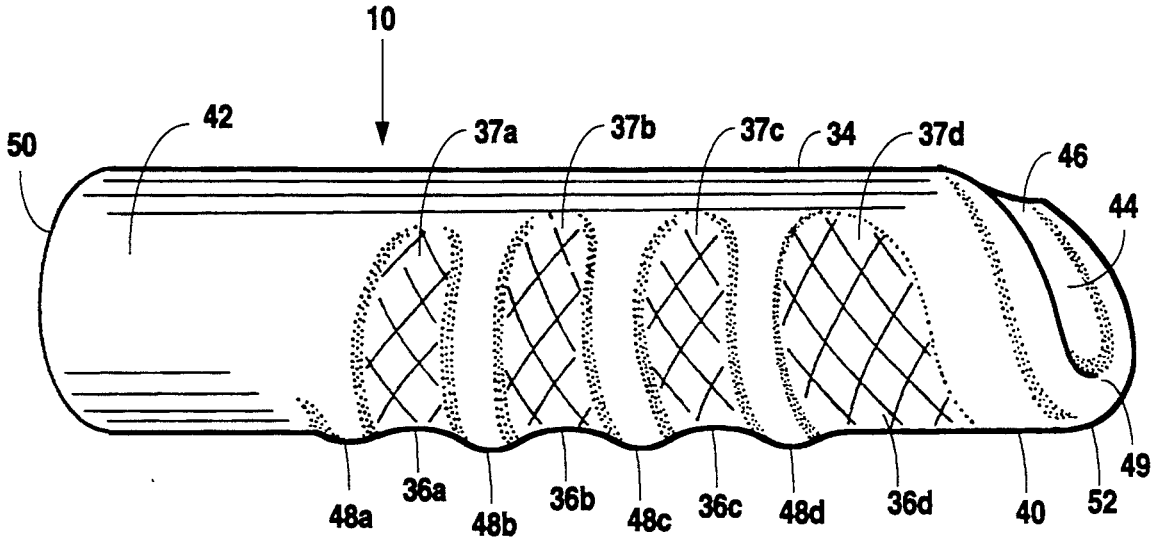
FIG. 2 is a perspective view of the present invention (left grip).

A perspective view of grip 10 is shown in FIG. 2. The closed, inboard end 40 of tubular body 42, shows a u-shaped thumb depression or groove 44. The open end 46 of the u-shaped depression 44 is directed toward the flat surface 34 of grip 10, while the closed end 48 of the u-shaped depression is approximately 180° opposite the flat surface 34. Depression 44 has a taper to accommodate the normal curvature of the rower's thumb. FIG. 2 also illustrates four ridges 48*a*, 48*b*, 48*c* and 48*d* which cooperate to form three inner finger grooves 36*a*, 36*b* and 36*c* and an outer index finger surface 36*d*.

Ridges 48*a–d*, finger grooves 36*a–c*, and index finger surface 36*d* extend generally around three fourths of the elliptical shaped outer surface of the tubular body 42 which is not flattened or truncated. It should be noted that ridges 48*a–d* extend approximately $\frac{1}{8}''$ to $\frac{1}{4}''$ above the base of the grooves. The inner surface of grooves 36*a–c* and finger surface 36*d* may be roughened, cross-hatched, or textured to reduce slippage. Index finger surface 36*d* may be slightly recessed in some embodiments of the present invention to further facilitate gripping.

Figure 3:
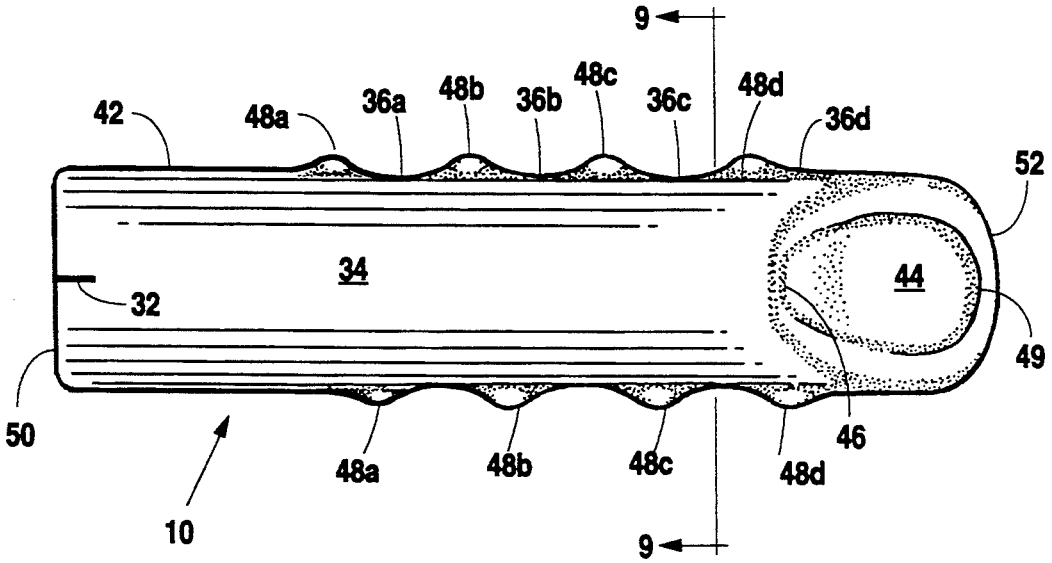
FIG. 3 is a side elevation view of the present invention (left grip) in a first position.

FIG. 3 illustrates side elevation view of the present grip 10 in a first position as viewed from the thumb end. As shown in FIG. 3, alignment indicia 32 is scribed near the open end 50 of tubular body 42, on flat, truncated surface 34. On the opposite closed end of tubular body 42 is u-shaped thumb depression 44. As previously stated, depression 44 tapers outwardly to conform to the rower's thumb, beginning at an approximate 45° angle tapering from the flat surface 34 to an angle of approximately 85° at the utmost end 52 of grip 10.

FIG. 3 also illustrates that the height of ridge 48*a* is slightly lower (1/16″–1/32″) than ridges 48*b–d*. The angular slanting of the ridges across the outer surface of body 42 may be noted by observing the slight offset of ridges 48*a–b* at the top of FIG. 3 from the position of the ridges at the bottom of FIG. 3.

The first position noted in FIG. 3 is approximately the same position in which grip 10 is seen in FIG. 1. In FIG. 3, the alignment mark 32 would be aligned with the centerline of the convex face of the blade when the grip is installed on the handle of the oar.

Figure 4:
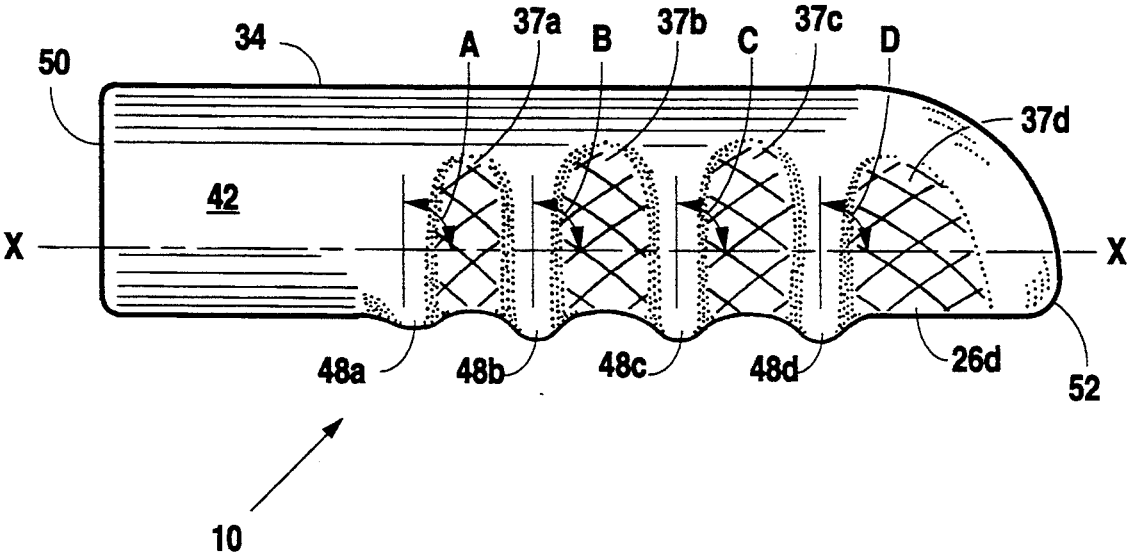
FIG. 4 is a side elevation view of the present invention (left grip) in a second position, rotated approximately 90° clockwise from the first position as viewed from the thumb end.

Turning to FIG. 4, the present grip 10 is shown in a second rotated position. If the grip were viewed from the thumb end 52, the second position of FIG. 4 shows the grip 10 rotate 90° clockwise from the first position. Flat surface 34 is shown at the top of FIG. 4. When the rower's fingers engage the grip 10 during rowing operation the distal tips of his fingers would lie near the ends 37*a*, 37*b* and 37*c* of grooves 36*a*, 36*b* and 36*c*, respectively, and the distal tip of the rower's index finger would lie near the end 37*d* of finger surface 36*d*.

As may be seen in FIG. 4, the angularity of the ridges across the outer surface of the tubular body is almost at 90° (as measured from the horizontal axis X). Angles A–D are very nearly perpendicular with axis X. The variation in the angularity of the ridges across the outer surface of the tubular body 42 gradually varies as the ridges run along the outer circumference as will be seen below.

Figure 5:
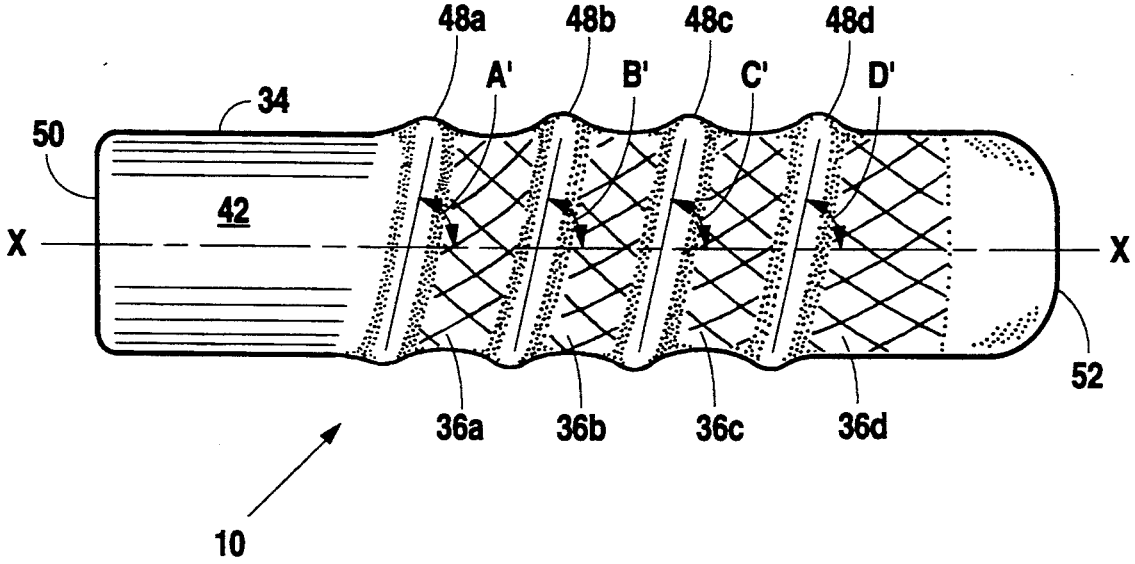
FIG. 5 is a side elevation view of the present invention (left grip) in a third position, rotated approximately 180° clockwise from the first position as viewed from the thumb end.

In FIG. 5, grip 10 has been rotated 180° from the first position. The angularity of the ridges across the outer surface of body 42 are noted as angles A′, B′, C′ and D′. A′ is approximately 88°–90°, B′ is approximately 85°–88°, C′ and D′ are approximately 80°–85°. These angles approximate the natural anatomical configuration of the human hand as it wraps around a handle in the rowing action.

Figure 6:
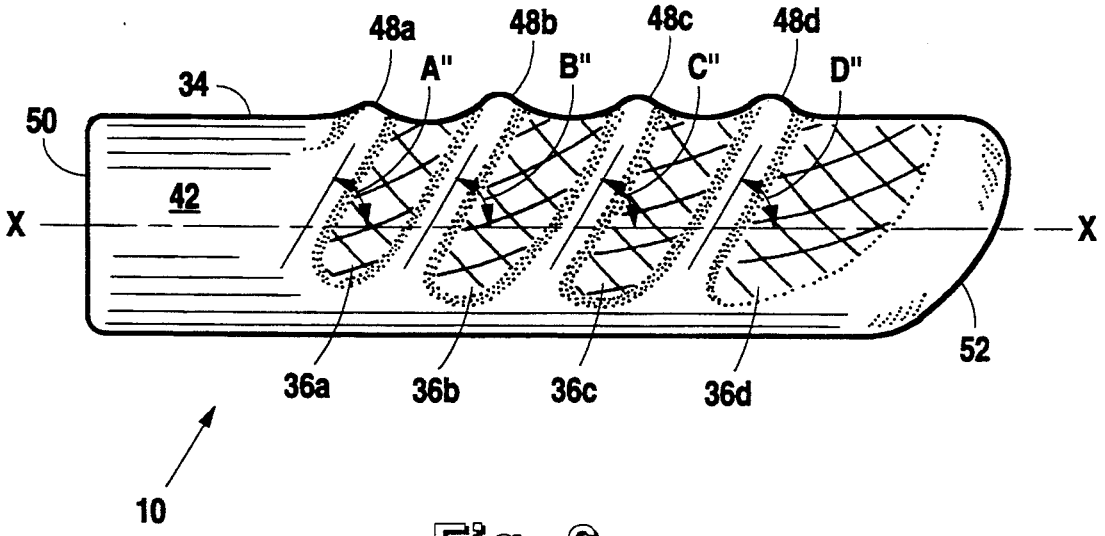
FIG. 6 is a side elevation view of the present invention (left grip) in a fourth position, rotated approximately 270° clockwise from the first position as viewed from the thumb end.

FIG. 6 illustrates the grip 10 rotated 270° from the first position. In the fourth position shown in FIG. 6, the angular orientation of the ridges 48*a–d* is readily apparent.

In FIG. 6, the proximal ends of the rower's fingers closest to his palm would lie against area 35*a*, 35*b* and 35*c* in grooves 36*a*, 36*b* and 36*c*, respectively, with the proximal end of the rower's index finger lying against index finger area 35*d* on finger surface 36*d*.

In FIG. 6, ridge 48*a*initially crosses the outer surface of the tubular body at an angle A″ of approximately 85°–88°. Ridge 48*b* has an initial angle B″ of approximately 80°–85°. Ridge 48*c* has an initial angle C″ of approximately 60°–80°. Ridge 48*d* has an initial angle D″ of approximately 60°–80°. All angels, A–D, are measured from the horizontal axis X. While the angles recited above appear to work effectively, slight angular variations are expected to provide a fully functional grip 10.

Figure 7:
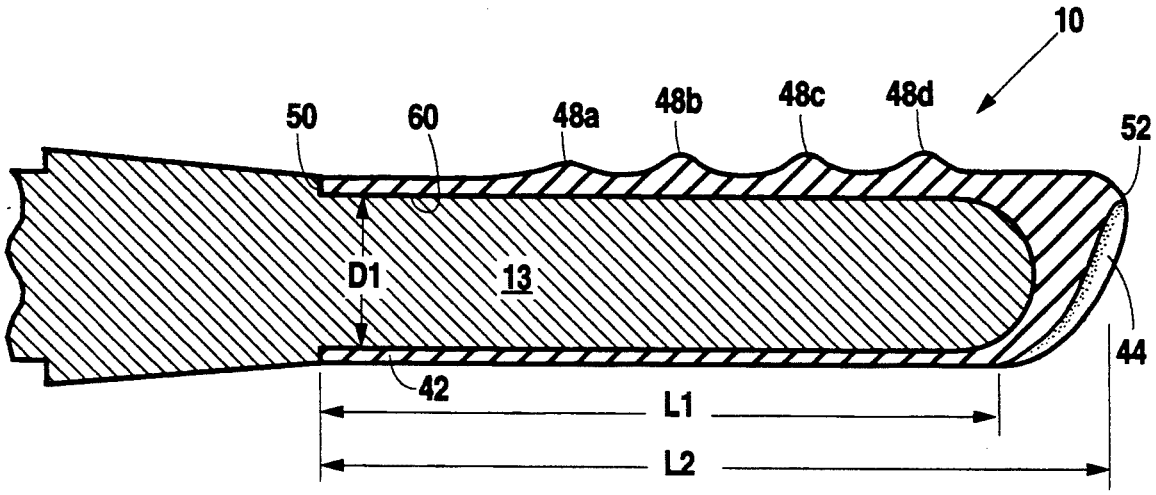
FIG. 7 is a cross-sectional view of the present invention (left grip) in the fourth position as affixed to an oar handle.

FIG. 7 illustrates the present grip 10 in a cross-sectional view. Open end 50 of elastic body 42 stretches open to receive handle 13 of oar 12. The handle 13 fits securely inside of the hollow chamber 60 formed inside body 42. On the closed, inboard end 52 of body 42, is u-shaped thumb depression 44.

Figure 8:
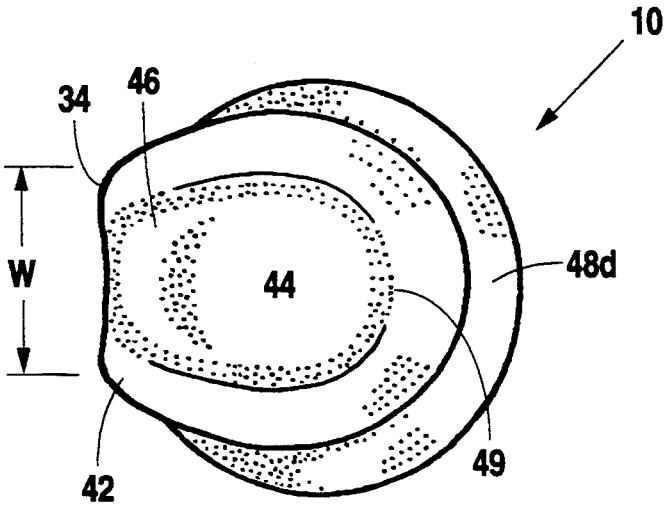
FIG. 8 is a thumb end view of the present invention (left grip).

Turning to FIG. 8, a thumb end, elevation view of grip 10 is shown. The generally truncated elliptical profile or shape of the tubular body 42 of grip 10 may be readily seen. Thumb depression 44 is shown with the open position 46 of the u-shape directed toward flat surface 34, and the closed portion of the u-shape directed opposite the flat surface. Inboardmost ridge 48*d* may be seen in FIG. 8.

Figure 9:
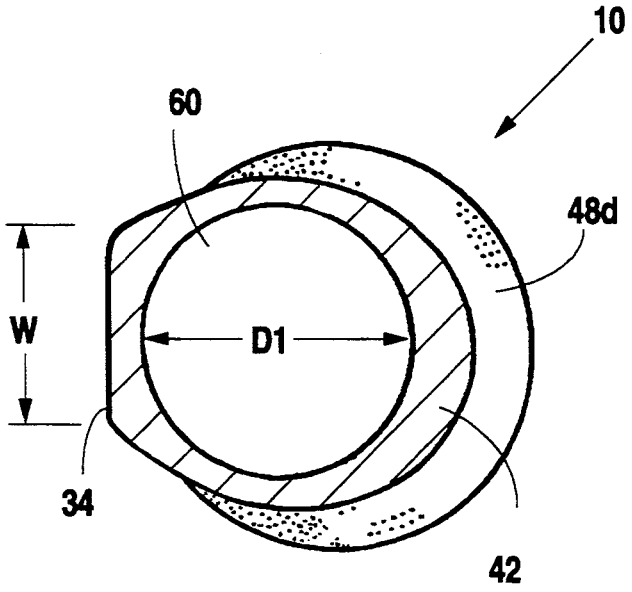
FIG. 9 is a cross-sectional view of the present invention (left grip) taken along line 9—9 of FIG. 3.

A cross-sectional elevation view taken along line 9—9 of FIG. 3 is illustrated in FIG. 9. FIG. 9 further discloses the slight elliptical shape of the outer surface of body 42, and the truncated portion 34 of this elliptical shape. The elliptical shape encourages the rower to actually grasp the grip 10 with only the fingers rather than engaging or contacting the grip with the palm of the hand.

The present inventive grip 10 has a length L1 from the open end to the open portion of the u-shape in the thumb depression of approximately 5¾″, and a length L2 from the open end to the utmost inboard closed end of approximately 6¼″. The grip has an inside diameter of approximately 1⅛″. The flat surface 34 is approximately 1⅜″–1½″ wide (reference letter W in FIG. 8).

The inventive grip may be used to replace existing grips on oars. The present grip 10, is affixed to an oar by inserting the handle of the oar into the open end 50 of the elastic grip 10, and urging the handle until it abuts the inside of the closed end of hollow chamber 60 of the grip. The grip is rotated on the handle until the alignment indicia 32 is longitudinally aligned with the centerline 26 of the convex side 20 of the oar blade. To improve fixation of the grip on the oar handle, an adhesive may be applied to the handle before insertion into the grip. Once the adhesive sets, the grip will not rotate and the alignment of the grip to the convex side of the oar blade is fixed.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. An oar grip, an oar having a generally cylindrical shaft with a blade member on an outboard end of said shaft, and a handle on an inboard end of said shaft, said blade member having a first face and a second face, said grip comprising:

an elongated elastic tubular body having a first end open to a hollow chamber inside said body, a second closed end, and a generally flat side extending from said open end to said closed end, said open end adapted to receive said handle of said oar;

a plurality of contiguous finger grooves formed circumferentially along an outer surface of said tubular body opposite said flat side, said plurality of contiguous finger grooves extending diagonally across said outer surface;

a thumb depression in said outer surface of said tubular body at said closed end; and an alignment indicia on said flat side of said tubular body for aligning said flat side of said tubular body with a centerline of said first face of said blade member thereby generally aligning said grooves with said second face of said blade member when said handle is received into said grip.

2. The grip of claim 1 wherein said diagonally extending grooves are angled in the range of 60° to 88° from a horizontal axis of said tubular body.

3. The grip of claim 1 wherein said grooves further comprise an outer ridge and three inner ridges on said outer surface of said tubular body, said outer ridge having a lower height than said three inner ridges.

4. The grip of claim 1 wherein said thumb depression is u-shaped, tapering outwardly from said flat side to an utmost end of said closed end of said tubular body.

5. The grip of claim 1 wherein said tubular body has a truncated elliptical profile.

* * * * *